US005356229A

United States Patent [19]

Hickman et al.

[11] Patent Number: 5,356,229

[45] Date of Patent: Oct. 18, 1994

[54] PRINT MEDIUM HANDLING SYSTEM TO CONTROL PEN-TO-PRINT MEDIUM SPACING DURING PRINTING

[75] Inventors: Mark S. Hickman; Chris Lesniak, both of Vancouver, Wash.

[73] Assignee: Hewlett-Packard Company, Palo Alto, Calif.

[21] Appl. No.: 71,417

[22] Filed: Jun. 3, 1993

[51] Int. Cl.[5] ..... B41J 2/00

[52] U.S. Cl. ..... 400/642; 271/188; 347/8

[58] Field of Search ..... 400/126, 55, 56, 59, 400/611, 617, 578, 624, 642, 619, 656; 346/140, 134; 271/188, 209

[56] References Cited

U.S. PATENT DOCUMENTS

| | | | |
|---|---|---|---|
| 3,915,281 | 10/1975 | Blomquist et al. | 400/569 |
| 4,311,401 | 1/1982 | Hiki et al. | 400/656 |
| 4,664,545 | 5/1987 | Hanyu et al. | 400/642 |
| 4,728,963 | 3/1988 | Rasmussen et al. | 346/25 |
| 4,750,006 | 6/1988 | Hashimoto | 346/134 |
| 4,843,338 | 6/1989 | Rasmussen et al. | 400/56 |
| 4,853,255 | 8/1989 | Onishi et al. | 427/148 |
| 5,065,169 | 11/1991 | Vincent et al. | 346/140 R |
| 5,066,151 | 11/1991 | Durr et al. | 400/642 |

FOREIGN PATENT DOCUMENTS

| | | | |
|---|---|---|---|
| 3265670 | 11/1988 | Japan | 400/617 |

*Primary Examiner*—Edgar S. Burr
*Assistant Examiner*—Anthony H. Nguyen

[57] ABSTRACT

Printer mechanism to control pen-to-print medium spacing during printing is described. The preferred embodiment of the mechanism includes a printhead, a platen positioned adjacent the printhead to define a print zone therebetween, and the print zone having an entrance region and an exit region. The print mechanism further includes a feed mechanism positioned generally adjacent the print zone entrance area and a height limiter positioned downstream of the print zone exit area. In the preferred embodiment, the platen includes a generally flat region and a generally inclined region. The generally inclined region includes a relatively downstream edge which contacts a sheet of print medium along a line of contact. In operation, the edge and the feed mechanism suspend the sheet material such that the sheet is generally concavely curved relative to the printhead between the edge and the feed mechanism, thereby ensuring proper pen-to-print medium spacing during printing.

14 Claims, 4 Drawing Sheets

16
38
40
42
20a
26
20
48
26c
44
14
12
14b
20b
B
18
14a
22a
22
24
46
12a
14c
22b
14d
38a
38b
A
10
26a
26b
C

PRINT MEDIUM HANDLING SYSTEM TO CONTROL PEN-TO-PRINT MEDIUM SPACING DURING PRINTING

TECHNICAL FIELD

The present invention relates generally to pen-to-print medium spacing during printing in a wet ink printer. More particularly, the invention concerns an apparatus that reduces uncontrolled bending of print medium in a print zone, the print zone positioned adjacent the pen.

BACKGROUND ART

Typically ink-jet printers, or any printers using wet ink, include a pen, also called a printhead, a print zone positioned adjacent the printhead, a feed mechanism for feeding print medium through the print zone, and a platen positioned adjacent the print zone, the platen guiding and supporting the print medium in the print zone during printing.

During printing, ink is placed on the print medium by dropping or ejecting the ink from the printhead, or by any other printing method well known by those skilled in the art. Ink used in wet ink type printing includes a relatively large amount of water. As the wet ink contacts the print medium, the water in the ink saturates the fibers of the print medium, causing the fibers to expand, which in turn causes the print medium to buckle. Buckling of the print medium tends to cause the print medium either to bend downwardly away from the printhead, or to bend upwardly toward the printhead. In either case, a constant pen-to-print medium spacing is not achieved, leading to poor print quality. Additionally, upwardly buckling print medium may contact a pen nozzle, leading to ink smearing on the print medium.

Typically, to achieve good print quality, pen-to-print medium spacing of less than 1.5 millimeter (ram), and preferably less than 1.0 mm, is required. However, bending amplitudes of print medium in certain pen/ink combinations can be greater than 3 mm. To reduce this problem of paper buckling, which varies the pen-to-print medium spacing, various shaped platens were designed.

The Hewlett-Packard Deskjet (a trademark of Hewlett-Packard) printer includes a platen with a flat print medium contacting surface and a feed mechanism, usually a drive roller, positioned adjacent the platen. The flat expanse of the platen is positioned below the printhead such that the platen supports the print medium throughout a print zone defined between the printhead and the platen. The feed mechanism is positioned such that print medium is fed at a downward angle onto the platen such that the print medium is concavely curved relative to the printhead in an initial region of a print zone. This small region of concave curvature generally does not extend under the pen nozzles of the printhead. Thus, when the print medium does not buckle, the print medium merely lies flat against the contacting surface of the platen throughout the print zone. However, when the print medium buckles during printing the flat platen prevents the print material from buckling downwardly away from the printhead and so the print medium is forced to buckle upwardly toward the printhead. Thus, the Deskjet device does not adequately ensure proper pen-to-print medium spacing. In addition, the device increases the risk of ink smearing due to possible pen-to-print medium contact when the print material buckles upwardly.

The Hewlett-Packard Paintjet XL (a trademark of Hewlett-Packard) printer includes the elements of the Deskjet printer, but also includes a second drive roller positioned adjacent an exit area of the print zone. Thus, print media are fed downwardly onto the platen from the feed mechanism, or first drive roller, extend throughout the print zone, and then travel over the second drive roller, such that the print medium are positioned between the drive roller and an adjacent star wheel. The second drive roller is positioned generally above the platen such that the first drive roller and the second drive roller may effect a generally concave curve in the print medium relative to the printhead, throughout the print zone. Since the print medium is gripped between a paper guide and the first drive roller on one side of the printhead, and the print medium is gripped between the second drive roller and a star wheel on another side of the printhead, the sheet of print medium is held in a controlled curve throughout the print zone. This controlled curve ensures proper pen-to-print medium spacing during printing, thereby ensuring good quality printing. However, inclusion: of the second drive roller in the Paintjet XL printer increases the cost and complexity of the printer. Also, the possibility of ink smearing is increased due to the star wheel contacting the freshly printed print medium, such that the star wheel presses the print medium against the second drive roller. Additionally, intake problems can arise when sheets of print media are improperly fed between the second drive roller and the star wheel.

The Hewlett-Packard Designjet (a trademark of Hewlett-Packard) printer includes a driver roller positioned beneath a printhead, the drive roller acting as a rotating platen. Specifically, sheets of print medium are fed through a print zone defined between the drive roller and the printhead. The sheets are held in contact with the curved outer surface of the drive roller on one side of the printhead by a paper guide positioned adjacent the roller, and on the other side of the printhead by a star wheel positioned adjacent the drive roller. In this arrangement, print medium are held in a generally convexly shaped curve relative to the printhead throughout the print zone. However, due to the curved surface of the drive roller, the print zone in such Designjet printers must be relatively narrow to achieve an acceptable pen-to-print medium spacing. For example, a drive roller having a radius of 31.75 mm (1.25-inches) ensures adequate print medium bending control, but would require a small print zone, and therefore a short printing array of ink nozzles in the printhead. A 12.70 mm (½-inch) printing array, for example, in combination with a 31.75 mm (1.25-inch) radius roller would result in a 0.63 mm (0.02-inches) change in pen-to-print medium spacing due to the drive roller curvature alone. Additionally, the possibility of ink smearing is increased due to the star wheel contacting the freshly printed medium, and forcing the medium against the surface of the drive roller.

DISCLOSURE OF THE INVENTION

The invented print medium handling system represents an inexpensive solution to the problem of uncontrolled print medium bending in a print zone without an increase in the possibility of ink smearing. The preferred embodiment includes a printhead and a platen defining a print zone therebetween, and a feed mechanism, such as a drive roller, positioned adjacent an entrance area of the print zone. The platen includes a generally flat expanse and an inclined region, the inclined region including an edge which contacts the underside of the print medium along a line of contact. The feed mechanism feeds the sheet into the print zone preferably downwardly toward the platen such that the sheet contacts the platen along a line of contact. Thus, the print medium, or print material, is suspended in a generally concavely shaped curve relative to the printhead between the line of contact, the line of contact being positioned along the flat region or on the edge depending on the stage of printing, and between the feed mechanism. Downstream of the edge, the print material is unsupported, such that the print material can buckle downwardly, away from the printhead, avoiding the problem of ink smearing. Typically, the inclined region edge is positioned generally adjacent a print zone exit region such that the print material is concavely curved relative to the printhead generally throughout the print zone, and is convexly curved relative to the printhead in the exit region of the print zone. In this arrangement the platen supports the print material along a line of contact and effects a controlled curve in the print material to ensure proper pen-to-print material spacing during printing.

These and additional objects and advantages of the present invention will be more readily understood after a consideration of the drawings and the detailed description of the preferred embodiment.

DETAILED DESCRIPTION OF THE PREFERRED EMBODIMENT AND BEST MODE OF CARRYING OUT THE INVENTION

Figures 1A, 1B, 1C:
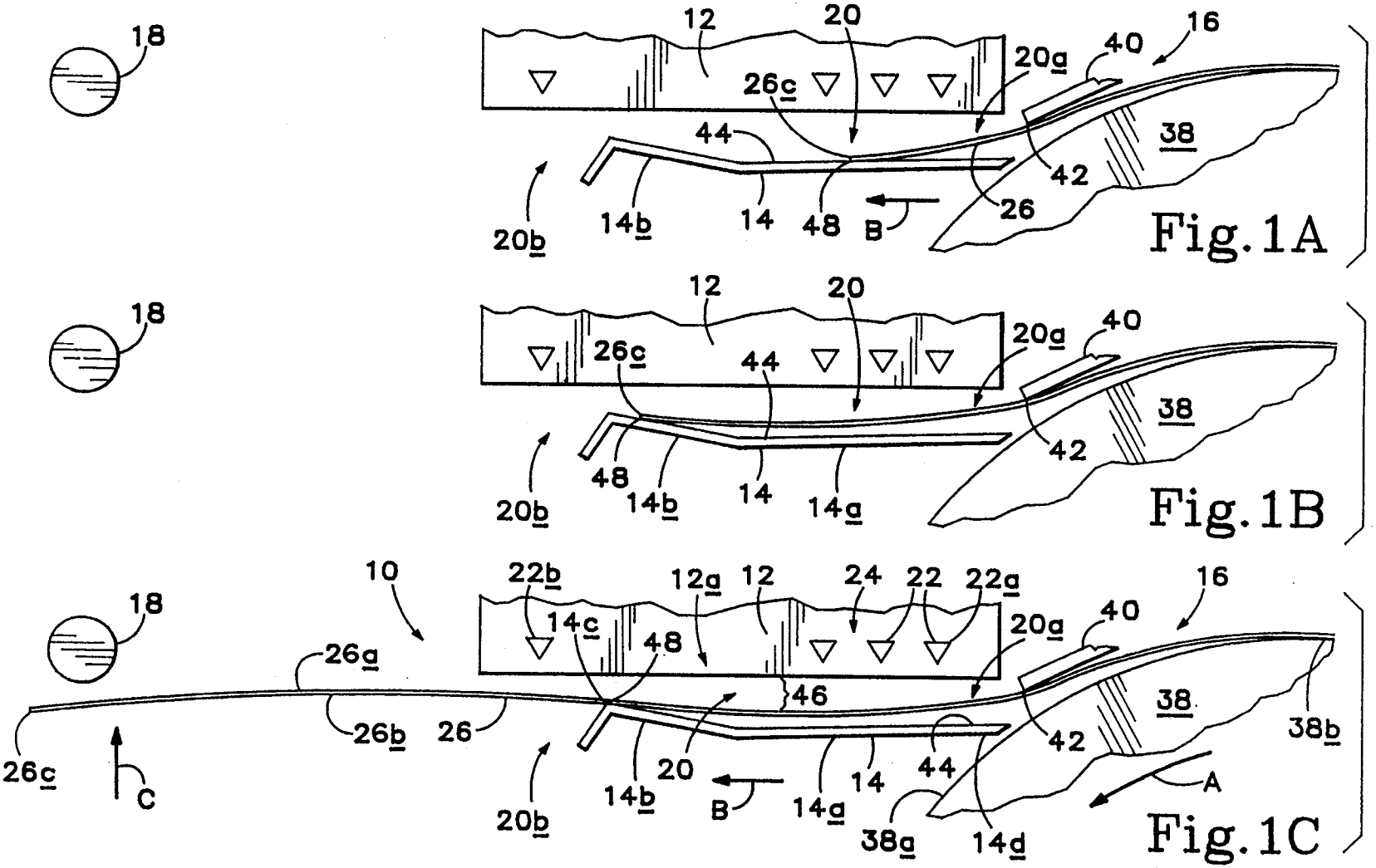
FIG. 1A shows the preferred embodiment of the print material handling system with a sheet of print material in an initial stage or printing.
FIG. 1B shows the print material handling system of FIG. 1A wherein a sheet of print material is in an intermediate stage of printing.
FIG. 1C shows the print material handling system of FIG. 1A wherein a sheet of print material is in a final stage of printing.

The print material handling system 10, of the preferred embodiment is shown in FIGS. 1A–1C. The handling system can also be thought of as a printer mechanism, a print medium handling subsystem, a print medium support apparatus and a print medium suspension system. In the preferred embodiment, system 10 includes a pen or printhead 12, a platen 14 and a feed device, or mechanism, shown generally at 16. The system may also include a height limiter 18. Additionally, platen 14 is positioned generally adjacent printhead 12 such that a print zone 20 is defined therebetween.

Typically, printhead 12 includes one or more nozzles 22 which together comprise a printing array 24. Printhead 12 may be referred to as a pen or an ink-jet printhead. In operation, nozzles 22 drop or eject ink droplets onto an upper surface **26*a* of a sheet of print material 26 positioned adjacent the printhead 12. Typically, printhead 12 is horizontally positioned such that nozzles 22 are located on an underside region 12*a* of printhead 12. However, the printhead may be vertically arranged such that the nozzles are positioned on a side of the printhead 52 (shown in FIG. 4) wherein the sheet of print material is positioned adjacent the side of the printhead 52**.

In operation, the nozzles drop or eject ink onto the upper surface **26*a*** of the sheet of print material. Typically, the ink includes a relatively large amount of water such that when the ink is placed on a sheet of print material, the ink saturates the fibers of the print material, thereby causing the fibers to expand which in turn causes buckling of the sheet material. For purposes of this invention, the sheet material can by mylar, paper, cardboard, envelope material or any such sheet material. The ink may be any liquid based wet-ink, or any other ink that causes sheet material buckling.

Figure 6:
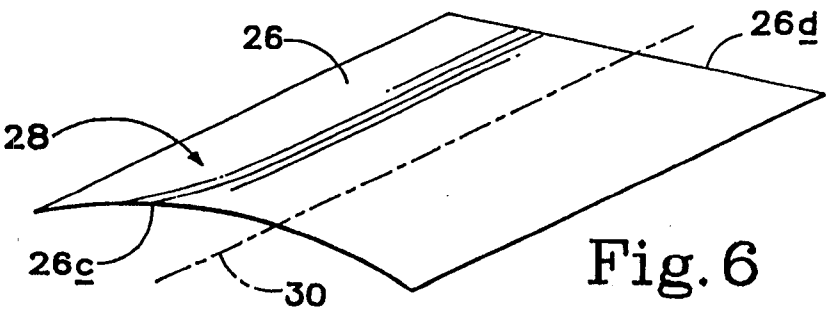
FIG. 6 discloses a sheet of print material wherein the sheet has "U" shaped bending.
Figure 5:
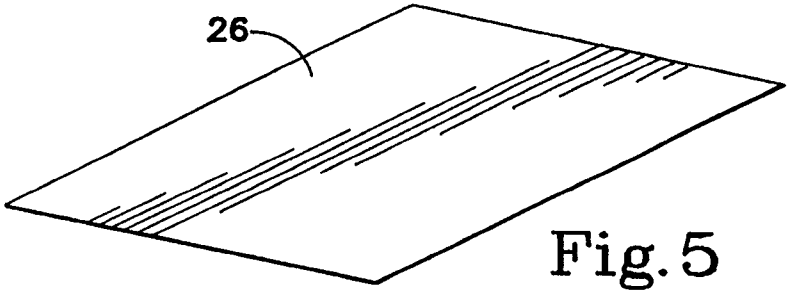
FIG. 5 shows a sheet of unprinted print material.
Figure 8:
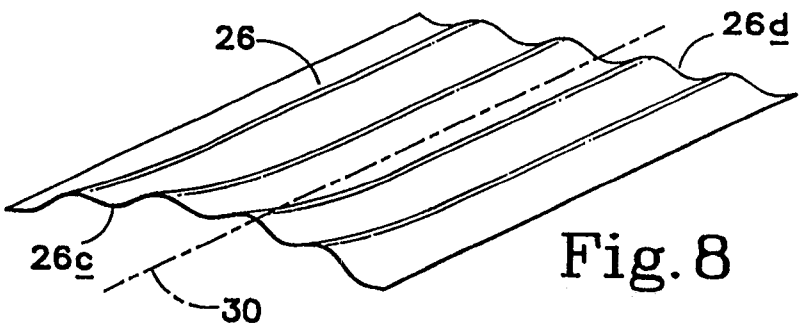
FIG. 8 shows a sheet of print material having "U" type and wave type bending.
Figure 7:
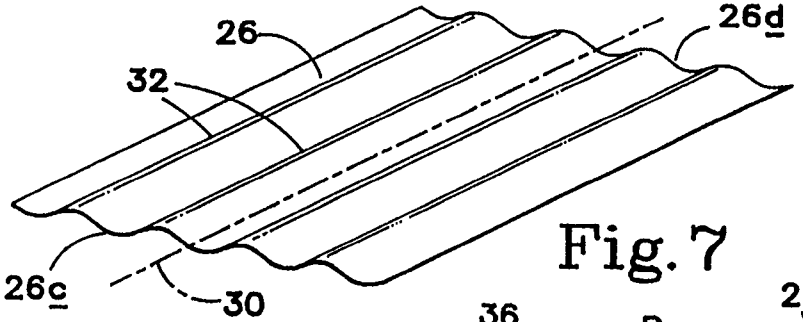
FIG. 7 shows a sheet of print material wherein the sheet has wave shaped bending.

FIG. 5 shows an unprinted sheet of print material 26 in a flat configuration. FIG. 6 shows a printed upon sheet 26 having a leading edge **26*c* and a trailing edge 26*d*. Sheet 26 is bent in a generally truncated cone shape 28 such that leading edge 26*c* has a generally inverted "U" type shape. Truncated type bending 28 is typically symmetrical about elongate axis 30 of sheet 26. FIG. 7 discloses a printed upon sheet 26 bent in a wave, or accordion, type shape 32. The wave shaped bends 32 are generally parallel to elongate axis 30 such that leading edge 26*c* is generally wave, or zig-zag, shaped. FIG. 8 discloses a printed upon sheet 26 which includes truncated cone type bending 28 and wave type bending 32, both types of bending being generally parallel to elongate axis 30 such that leading edge 26*c*** has a generally inverted "U" type shape and in a generally wave type shape.

In the preferred embodiment, feed mechanism, or first structure, 16 includes a drive roller 38 (only a section of the drive roller is shown) and a print material guide 40 (refer to FIG. 1C). The feed mechanism, or medium-feeding mechanism 16, is typically positioned adjacent the printer input port or entrance region **20*a*. In operation, drive roller 38 picks a sheet from an input tray containing a stack of sheet material (not shown) and feeds or advances the sheet into print zone 20. Specifically, a sheet of print material 26 is picked from an input tray and held against the driver roller by pinch rollers (not shown) such that the under surface 26*b* of sheet 26 contacts the outer surface 38*a* of roller 38 as the roller rotates in direction A. The upper-most point 38*b* of roller 38 is typically positioned in a plane vertically above print zone 20 such that roller 38 conveys sheet 26 generally downwardly into print zone 20 and forwardly along feed direction or feed axis B. Print material guide 40 contacts the upper surface 26*a* of the sheet and cooperates with the drive roller to bias the sheet downwardly into the print zone thereby ensuring the sheet avoids contact with first nozzle 22*a***. Typically, an end 14*d* of platen 14 is positioned generally adjacent drive roller 38 to prevent sheet 26 from continuing around drive roller 38 in direction A.

As shown in FIG. 1C, print material guide 40 generally contacts sheet 26 along a line, or region, of contact 42 such that the guide, the roller and the platen cooperate to effect a concavely curved shape in the sheet, relative to drive roller 38, upstream of contact line 42 and a generally concavely curved shape in the sheet, relative to printhead 12, downstream of contact line 42. Thus, contact line 42 defines a first line of inflection 34 (refer to FIG. 9) such that the sheet is concavely curved in one direction upstream the line of inflection, and concavely curved in an opposite direction downstream the line of inflection.

In the preferred embodiment, as shown in FIG. 1A, platen, or second structure, 14 includes a fiat expanse 14*a*, also called a first region or a fiat region. Additionally, platen 14 is preferably fixed, or stationary, thereby reducing manufacturing costs, and reducing the complexity of the system. Platen 14 is typically positioned adjacent or opposite the printhead 12 and the print zone 20 such that the platen is coextensive with the printhead along feed axis B. However, the platen may also be positioned adjacent the printer output port 20*b*. Platen, or support surface, 14 also includes an inclined or elevated second region 14*b* having an edge 14*c* which typically extends outwardly from flat region 14*a*. Edge 14*c* can also be referred to as a raised edge, a raised ledge, or an elevated region. In operation, feed mechanism 16 conveys sheet 26 into an entrance region, or input port, 20*a* of the print zone such that leading edge 26*c* of sheet 26 contacts the upper surface 44 of platen 14 in flat region 14*a*. Because of the position of drive roller 38 generally above platen, or support structure, 14, sheet 26 is generally concavely curved relative to printhead 12 in print zone entrance region 20*a*. As sheet 26 is conveyed through the print zone, leading edge 26*c* moves in direction of travel B along flat expanse 14*a* of platen 14 such that expanse 14*a* supports the print medium along a line or region of contact 48. As leading edge 26*c* is conveyed through the print zone, leading edge 26*c* contacts flat region 14*a* and thereafter contacts inclined region 14*b*. During this initial or first stage of printing, the feed mechanism forces leading edge 26*c* against expanse 14*a* and creates a controlled curve in the sheet, thereby reducing uncontrolled bending of the sheet in print zone 20. In this arrangement, the portion of the sheet in the print zone is suspended between the feed mechanism and the line of contact with the platen. Uncontrolled bending is typically relatively minor in this initial stage of printing because all the nozzles of printing array 24 have not yet printed on sheet 26.

As shown in FIG. 1B, as feed mechanism 16 further conveys sheet 26 in direction B, leading edge 26*c* contacts inclined region 14*b* of platen 14 along a line of contact 48 such that the inclined region, cooperating with feed mechanism 16, effects a generally concave shape in the sheet relative to printhead 12, in the portion of the sheet which is downstream of guide 40. Thus, in this intermediate stage of printing, inclined region 14*b* and feed mechanism 16 cooperate to effect a controlled curve in sheet 26 such that the sheet is suspended above expanse 14*a* and such that proper printhead-to-print material spacing 46 is maintained and such that sheet 526 is convexly curved relative to the platen generally throughout the print zone. In another way of describing the arrangement, feed mechanism 16 conveys a sheet through print zone 20 generally along axis of travel B. Feed mechanism 16 is configured for contacting the sheet in a first region of contact 42 transverse to axis of travel B such that the feed mechanism effects downward movement of the sheet 26 relative to printhead 12 and such that the feed mechanism effects forward movement of the print medium relative to feed axis B.

In the final, or second, stage of printing, shown in FIG. 1 C, leading edge 26*c* is conveyed over edge 14*c* of platen 14 and into print zone exit region, or output port 20*b*. In this arrangement, leading edge 26*c* is no longer supported by platen 14, and therefore is allowed to bend downwardly away from printhead 12. Because flat expanse 14*a* is located generally farther from printhead 12 than are edge 14*c* and guide 40, sheet 26 is suspended in a generally concavely shaped curve relative to printhead 12 and is generally suspended above expanse 14*a*. In the preferred embodiment, edge 14*c* contacts underside 26*b* of sheet 26 along a line, or a region, of contact 48 which is generally perpendicular to feed axis B, such that edge 14*c* generally supports sheet 26. Typically, line of contact 48 defines a second line of inflection 36 (refer to FIG. 9) in sheet 26 such that the sheet is concavely curved toward the printhead upstream of line of contact 48, and the sheet is convexly curved relative to printhead 12 downstream of line of contact 48.

In another way of thinking of the curvature or bending, sheet 26 is concavely curved relative to printhead 12 on one side of second line of inflection 36 and is concavely curved relative to the platen on the other side of the second line of inflection. The arrangement can also be thought of as ledge 14*c* cooperating with mechanism 16 to bias a trailing portion of sheet 26 upstream of the ledge into a predefined flexure, thereby stiffening the medium as it is conveyed past the printhead. In yet another manner of describing the sheet curvature, medium-feeding mechanism 16 biases medium 26 away from printhead 12 and ledge 14*c* biases the medium toward printhead 12 to produce a predeterminedly controlled, preferably concave flexure, relative to the printhead of a trailing portion of the sheet upstream ledge 14*c*.

The system can also be described as a platen 14 including an elevated region 14*b* being configured for supporting the print medium generally along line of contact 48 transverse to axis of travel B such that elevated region 14*b* biases the medium upwardly relative to printhead 12 and forwardly relative to axis B. Thus, the feed mechanism and the platen cooperate to suspend the print medium in a controlled curve between first region of contact 42 and line of contact 48 with edge 14*c* deflecting the sheet away from the printhead in print zone exit region 20*b*.

Due to this change in direction of curvature at line of contact 48, edge 14*c* prevents downstream bending of print material from propagating or backing upstream of edge 14*c*. Specifically, edge 14*c* supports a substantial portion of the spring force being exerted by the curved sheet of print medium. In addition, sheet buckling will tend to decrease radius R of angle $\phi$ (refer to FIG. 9) causing a greater resistive force against edge 14*c*. Thus, the spring force of the sheet 26 against edge 14*c* tends to flatten truncated cone type bending, as shown in FIG. 6 and tends to flatten wave type bending, as shown in FIG. 7. As another way of describing the arrangement, it is believed that as the transverse curvature of the sheet, i.e., the bend defined by angle $\theta$ or by angle $\phi$, is increased and as the radius of the curvature is decreased, the sheet is stiffened against buckling parallel to the sheet axis 30 as the area moment of inertia of the sheet is increased.

In another way of describing the arrangement, truncated cone type or "U" type bending and wave type bending are generally parallel to elongate axis 30 of the sheet 26. In contrast, as sheet 26 is fed from feed mechanism 16 into print zone entrance area 20*a* the system effects a bend 34 in the sheet, the bend being generally transverse to axis 30. Specifically, the sheet contacts platen 14 along a line of contact 48, shown in FIG. 1A, which forces the sheet into the controlled flexure, or bend 34, also represented by angle $\phi$, having radius R. (Refer to FIG. 9). Throughout the first stage of printing, the sheet is forced into this controlled flexure by the flat region 14*a* of the platen which contacts the sheet along a line of contact 48 at leading edge 26*c*. In the second phase of printing, the platen contacts leading edge 26*c* along line of contact 48 on platen inclined region 14*b* to effect bends 34 and 36, shown in FIG. 1B. In the third stage of printing, edge 14*c* effects bend 34 in sheet 26 by contacting the sheet at line of contact 48. In these stages of printing, the system effects a concave shape in the sheet, relative to printhead 12, the controlled concave shape inhibiting uncontrolled sheet cockling, or bending, generally throughout the print zone. The suspension of the sheet between the line of contact 48 on the platen and contact line 42 on feed mechanism 16 tends to flatten out wave and "U" type bends parallel to sheet axis 30.

Figure 9:
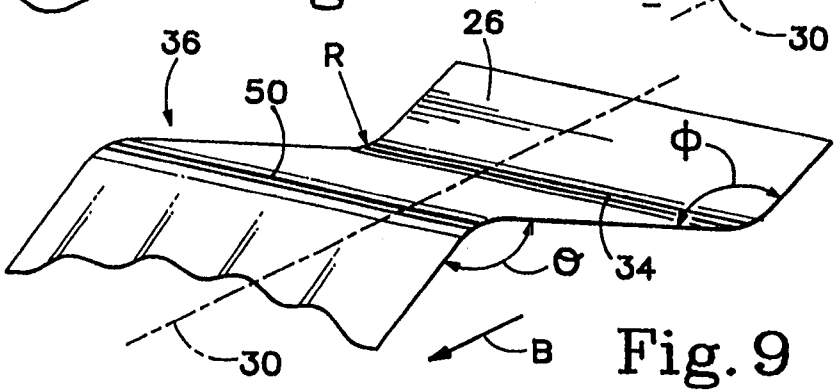
FIG. 9 shows the sheet of FIG. 8 with bends transverse to the "U" type and wave type bends.

Additionally, in the third stage of printing, sheet 26 tends to bend over edge 14*c* in a bend which runs generally perpendicular to the "U" type and wave type bends which are parallel to the sheet's elongate axis 30. Thus, as shown in FIG. 9, exaggerated for illustrative purposes, edge 14*c* effects a transverse bend 50 in sheet 26, transverse bend 50 being generally perpendicular to the sheet's elongate axis 30 and to the direction of feed B, also called direction of travel B. Due to the generally perpendicular arrangement between transverse bend 50 and the "U" and wave type bends, bend 50 reduces the possibility of "U" and wave type bends propagating backwardly, or upstream of transverse bend 50. Additionally, platen 14 does not support sheet 26 downstream of edge 14*c* which allows sheet 26 to buckle downwardly in this exit region 20*b*. This downward buckling or bending of sheet 26 in exit region, or output port, 20*b* further decreases, or reduces, the angle $\theta$ of transverse bend 50 about edge 14*c*. As angle $\theta$ of transverse bend 50 is decreased, or becomes smaller, the probability of "U" type or wave type bends effecting bending of the sheet upstream edge 14*c* is decreased. In addition as angle $\theta$ becomes smaller, the spring, or return, force of the sheet simultaneously decreases the size of angle $\phi$ and the length of radius R, proportionally to the deflection of the sheet over edge 14*c*.

If truncated cone or wave type bending does manage to propagate upstream pass transverse bend 50 and ledge 14*c*, the generally concave curved shape of sheet 26 relative to the printhead in the region upstream of edge 14*c* tends to force the buckling sheet 26 downwardly away from the printhead. In such a case, flat expanse 14*a* of platen 14 acts as a bend limiter, preventing the sheet from bending downwardly past the platen thereby ensuring proper printhead-to-print material spacing 46.

If the portion of sheet 26 in exit region 20*b* tends to buckle in direction C, height limiter 18, also called a flexure limiter, prevents sheet 26 from buckling or curving past flexure limiter 18. Height limiter, or medium guide structure, 18 is positioned generally downstream from print zone 20 and generally adjacent the upper surface 26*a* of sheet 26. Thus, flexure limiter 18 prevents sheet 26 from contacting last nozzle 22*b*. of print array 24 in printhead 12 while also ensuring proper printhead-to-print material spacing. In the preferred embodiment, last nozzle 22*b* extends approximately 3 mm, in direction of travel B, beyond edge 14*c*. In this arrangement, flexure limiter 18, typically including one or more laterally spaced star wheels, exerts a low contact force on sheet 26, i.e., star wheel 18 does not press sheet 26 against a hard surface, such as a drive roller. Due to the low contact forces exerted between star wheel 18 and sheet 26, freshly printed ink on upper surface 26*a* of the sheet is not smeared by star wheel 18. In another way of describing the arrangement, height limiter 18 limits or controls the extent of flexure of a leading portion of sheet 26 downstream ledge 14*c* and directs the leading portion toward the printer's output port 20*b*.

Figure 2:
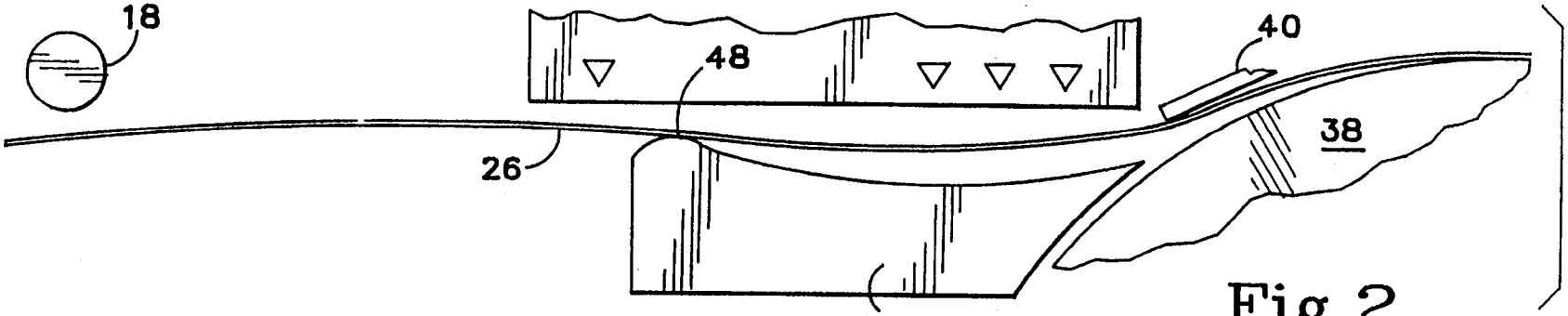
FIG. 2 shows another embodiment of the print material handling system.
Figure 3:
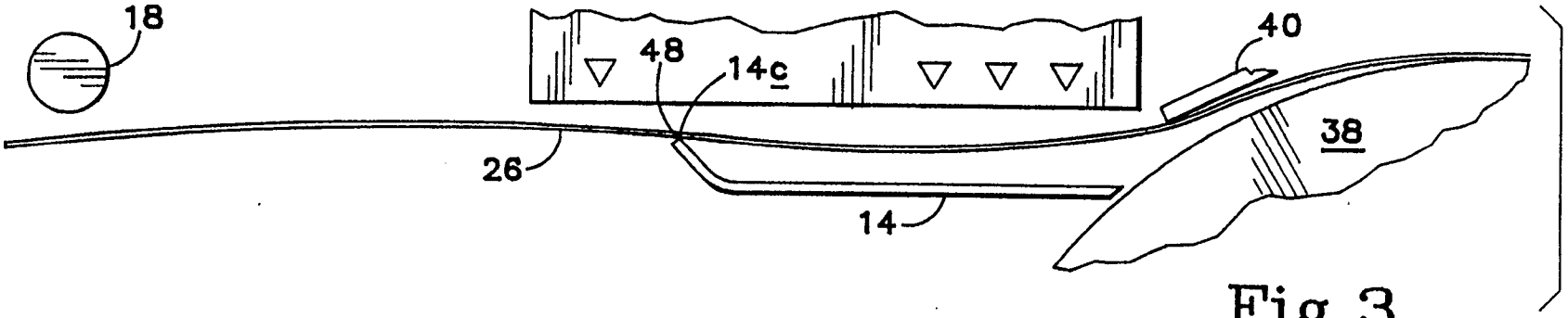
FIG. 3 shows yet another embodiment of the print material handling system.
Figure 4:
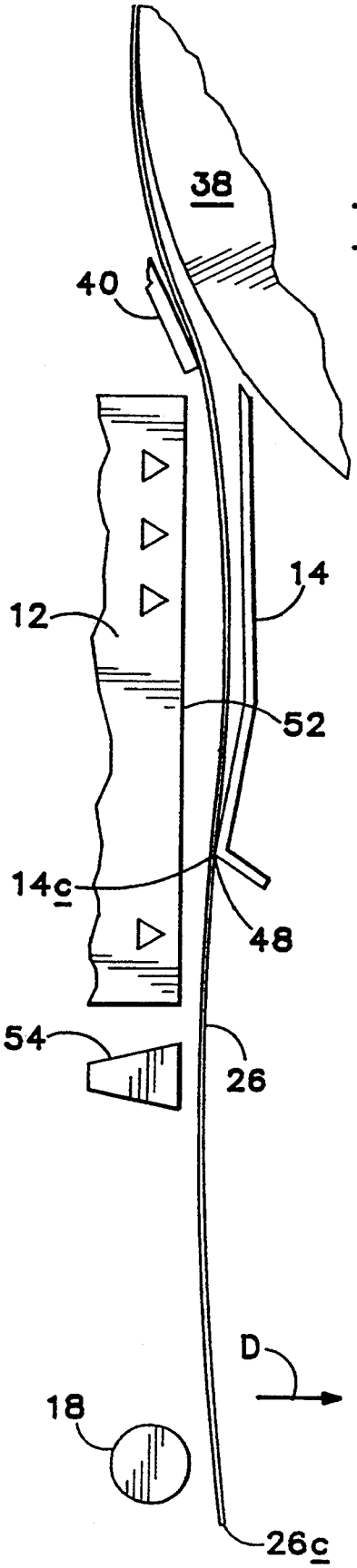
FIG. 4 shows another embodiment and another orientation of the print material handling system.

In another embodiment, shown in FIG. 2, platen 14 includes a stationary curved upper surface for contacting a sheet of print material. The platen preferably contacts a sheet along a line of contact such that the sheet is concavely curved relative to the printhead on one side of the line of contact. The print medium is concavely curved relative to the printhead on another side of the line of contact once the sheet's leading edge is conveyed over the platen's raised area 14*b* or ledge 14*c*. FIG. 3 discloses another embodiment in which edge 14*c* is also an end of platen 14. FIG. 4 discloses a side view of another embodiment with sheet 26 positioned generally vertically adjacent a side 52 of printhead 12. In this generally vertical orientation, sheet 26 is not forced by gravity around edge 14*c*. Therefore, in this embodiment the system further might, but does not need to, include an air blower 54, or the like, to effect movement of leading edge 26*c* in direction D such that platen edge 14*c* effects a bend in sheet 26 transverse to the elongate axis of the sheet.

INDUSTRIAL APPLICABILITY

It may be seen that the invented apparatus ensures proper printhead-to-print material spacing by reducing uncontrolled bending of print material in a print zone through use of a platen which contacts the sheet material generally along a line of contact. The inventive platen reduces uncontrolled bending of print material in the print zone without the incorporation of an expensive and complex second drive roller and without increasing the risk of ink smearing due to printhead-print material contact. The print medium handling system, which includes a platen with a raised edge, uses the print material's own elasticity to effect a controlled curve in the print material such that the cost of the printer is not appreciably increased.

While the present invention has been shown and described with reference to the foregoing operational principles and preferred embodiment, it will be apparent to those skilled in the art that other changes in form and detail may be made therein without departing from the spirit and scope of the invention as defined in the appended claims.

We claim:

1. A printer mechanism to control pen-to-print medium spacing during printing, the mechanism comprising:

a printhead for printing on a print medium; and means for effecting a concave flexure in the print medium relative to the printhead substantially throughout a print zone, said means including a platen positioned adjacent the printhead to define said print zone between the platen and the printhead, said platen being configured for contacting the print medium substantially along a line of contact in the print zone, said line of contact being transverse to a feed direction of the print medium, said platen being further configured so as to not contact said print medium other than along said line of contact, thereby reducing uncontrolled bending of the print medium in the print zone.

2. The printer mechanism of claim 1 wherein the printer mechanism includes a flexure limiter positioned substantially downstream from the print zone and substantially adjacent a top surface of the print medium, the flexure limiter preventing the print medium from bending beyond the height limiter in a direction toward the printhead thereby preventing the print medium from contacting the printhead.

3. The printer mechanism of claim 1 wherein the line of contact defines a line of inflection of the print medium such that the print medium is concavely curved relative to the printhead on one side of the line of inflection, and the print medium is concavely curved relative to the platen on the other side of the line of inflection.

4. The printer mechanism of claim 1 which further comprises a feed mechanism and wherein the platen includes a raised ledge in a downstream region of the print zone, the ledge for supporting the medium along the line of contact, the ledge and the feed mechanism cooperating to bias a trailing portion of the medium upstream the ledge into a predefined flexure, thereby stiffening the medium while it is advanced past the printhead.

5. The printer mechanism of claim 4 wherein the platen includes a region of flat expanse upstream from the ledge for supporting the medium's leading edge as the feed mechanism advances the leading edge toward the ledge.

6. The printer mechanism of claim 4 wherein the feed mechanism biases the medium away from the printhead and the ledge biases the medium toward the printhead to produce concave flexure of such trailing portion of the medium relative t the printhead.

7. The printer mechanism of claim 6 which further comprises a medium guide structure downstream the ledge, the guide structure limiting concave flexure of a leading portion of the medium downstream the ledge and directing such leading portion through an output port of the printer.

8. The printer mechanism of claim 1 which further comprises a feed mechanism, the feed mechanism configured for contacting the print medium in a first region of contact transverse to the feed direction of the print medium such that the feed mechanism effects downward movement of the print medium relative to the printhead, and such that the feed mechanism effects forward movement of the print medium relative to the feed direction, and the platen includes a elevated region, the elevated region being configured for supporting the print medium substantially along the line of contact such that the elevated region biases the medium upwardly relative to the printhead and forwardly relative to the feed direction, the feed mechanism and the platen cooperating to suspend the print medium in a controlled curve between the first region of contact and the line of contact.

9. The printer mechanism of claim 1 which further comprises a print medium feed device for conveying the print medium through the print zone during printing, the feed device being positioned substantially adjacent a print zone entrance region such that the print medium is convexly curved relative to the platen substantially throughout the print zone between the feed device and the line of contact on the platen.

10. The printer mechanism of claim 9 wherein the printer mechanism includes a flexure limiter positioned substantially adjacent a print zone exit region, the flexure limiter controlling the extent of flexure in the print medium.

11. A print medium handling subsystem for a printer having an ink-jet printhead, an input port and an output port, the subsystem comprising:

a mechanism to support a print medium in a controlled nonplanar flexure, said mechanism including a first structure for supporting the print medium during printing, the first structure positioned substantially adjacent the printer input port, and a second structure for also supporting one side of the print medium during printing, the second structure positioned substantially adjacent the printer output port, the first and second structures cooperating substantially throughout printing to suspend the medium in a controlled nonplanar flexure between the structures.

12. The subsystem of claim 11 wherein the second structure comprises a platen configured for contacting the print medium along a line of contact.

13. A print medium handling subsystem for a printer having an ink-jet printhead, an input port and an output port, the subsystem comprising:

a medium-feeding mechanism adjacent the printer's input port for advancing a sheet of print medium along a defined axis; and a support surface positioned between the input port and the output port structured such that the surface contacts the print medium only along a line of contact substantially perpendicular to the axis leaving the remainder of the support surface with the print medium substantially suspended above said remainder of the support surface, the line of contact being substantially adjacent the printer's output port.

14. The subsystem of claim 13 wherein the support surface includes a platen having an expanse including said remainder surface and a raised edge, the expanse supporting the print medium during a first stage of printing and the edge supporting the print medium during a second stage of printing.

* * * * *